United States Patent [19]

Wixon

[11] 4,000,077

[45] Dec. 28, 1976

[54] ENHANCEMENT OF CATIONIC SOFTENER

[75] Inventor: Harold Eugene Wixon, New Brunswick, N.J.

[73] Assignee: Colgate-Palmolive Company, New York, N.Y.

[22] Filed: May 4, 1972

[21] Appl. No.: 250,428

[52] U.S. Cl. ..... 252/8.75; 252/542; 252/547

[51] Int. Cl.[2] ..... D06M 6/00

[58] Field of Search ..... 117/139.5 CQ; 252/8.7, 252/8.75, 8.8, 547

[56] References Cited

UNITED STATES PATENTS

| | | | |
|---|---|---|---|
| 3,554,784 | 1/1971 | Lyness | 117/139.5 CQ |
| 3,644,203 | 2/1972 | Lamberti et al. | 252/547 |
| 3,703,480 | 11/1972 | Grand et al. | 252/547 |

*Primary Examiner*—Benjamin R. Padgett
*Assistant Examiner*—Christine M. Nucker
*Attorney, Agent, or Firm*—Norman Blumenkopf; Herbert S. Sylvester; Murray M. Grill

[57] ABSTRACT

A fabric softening composition having improved softening and whitening properties comprising a cationic quaternary softener, preferably an imidazolinium softener, and a higher aliphatic alcohol sulfate in the weight ratio of 10:1 to 2:1 of cationic: alcohol sulfate.

4 Claims, No Drawings

ENHANCEMENT OF CATIONIC SOFTENER

The present invention relates to a softening composition which imparts to textiles treated therewith a superior degree of softness and whiteness; containing as the essential ingredients a cationic quaternary softener — more specifically an imidazolinium salt, and a minor amount of a higher aliphatic alcohol sulfate.

The use of various and diverse chemical materials, and particularly cationic quaternary ammonium compounds as softeners for textile products, is very well known in the art. It is also well known to employ such materials for their softening effect during the laundering operation and particularly in the rinse cycle of the laundering process. This technique has been necessitated by the fact that the softeners heretofore employed, being mainly cationic in nature, are not compatible with the major type of detergent used in the washing cycle. By far, the predominating type of detergent used in home laundering processes is anionic in nature. It has been found that even traces of anionic materials results in a precipitate which greatly reduces the effectiveness of said cationic fabric softeners. This manifestation of incompatibility has necessitated the use of cationic quaternary softeners during laundering in the rinse cycle after several rinses to free said laundered fabrics of traces of anionic detergent.

Another disadvantage of cationic quaternary softening agents is the well known tendency of textiles treated therewith to yellow.

It has now been found that the addition of minor amounts of higher aliphatic alcohol sulfates to cationic quaternary softening agents enhances the softness and whiteness of fabrics treated therewith. This is unexpected, especially in view of the known incompatibility of even traces of anionics (the alcohol sulfate is anionic) with aforesaid cationic softeners.

Accordingly, a primary object of this invention is the provision of a cationic quaternary fabric softening composition possessing superior softening properties.

Another object of this invention is to provide a fabric softening composition devoid of any yellowing tendency.

Still another object of this invention is to provide a fabric softening composition possessing superior whiteness properties.

Other objects will appear hereinafter as the description proceeds.

In accordance with the above objects, the fabric softening composition of this invention comprises a cationic quaternary softener and a higher alcohol sulfate in the weight ratio of 10:1 to 2:1 of cationic:alcohol sulfate.

The cationic quaternary softening agents found useful in instant invention are commercially known and include quaternary ammonium compounds wherein typically at least one of the groups linked to the nitrogen atom is a higher alkyl group containing at least 12 carbon atoms and 2 or 3 of the groups linked to the nitrogen atom are lower alkyl or substituted alkyl groups which contain 1 to 6 carbon atoms; one or more of said lower alkyl groups may bear an aryl substituent or may be replaced by an aryl group such as a benzyl group; and there is present an anion such as halogen, acetate, methosulfate, etc. Typical quaternary ammonium compounds are ethyl-dimethyl-stearyl ammonium chloride, cetyl-dimethyl-benzyl ammonium chloride, dimethyl-distearyl ammonium chloride, benzyl-dimethyl-stearyl ammonium chloride, benzyl-dimethyl-stearyl ammonium bromide, trimethyl-stearyl ammonium chloride, trimethyl-cetyl ammonium bromide, diethyldistearyl ammonium chloride, diethyl-octyl-stearyl ammonium chloride, dimethyl-ethyl-lauryl ammonium chloride, dimethyl-methylethyl-lauryl-cetyl ammonium chloride, propyl-myristyl ammonium chloride, ditallow-dimethyl ammonium chloride, and the corresponding methosulfates, acetates, etc.

A preferred group of cationic quaternary ammonium softening agents are the imidazolinium salts, such as:

2-heptadecyl-1-methyl-1-[(2-stearoylamido)ethyl]-imidazolinium methyl sulfate, 2-heptadecyl-1-methyl-1-[(2-stearoylamido)ethyl]-imidazolinium chloride, 2-methyl-1-(2-hydroxyethyl)-1-benzyl imidazolinium chloride, 2-coco-1-(2-hydroxyethyl)-1-benzyl imidazolinium chloride, 2-coco-1-(hydroxyethyl)-1-(4-chlorobutyl-)imidazolinium chloride, 2-coco-1-(2-hydroxyethyl)-1-octadecenyl imidazolinium chloride, 2-tall oil fatty-1-(2-hydroxyethyl)-1-benzyl imidazolinium chloride, 2-tall oil fatty-1-(2-hydroxyethyl)-1-(4-chlorobutyl-)imidazolinium chloride, 2-heptadecenyl-1-(2-hydroxyethyl)-1-(4-chlorobutyl)imidazolinium chloride, 2-heptadecenyl-1-(2-hydroxyethyl)-1-benzyl imidazolinium chloride, 2-heptadecyl-1-(hydroxyethyl)-1-octadecyl imidazolinium ethyl sulfate.

Other known imidazolinium salts possessing softening properties may be utilized herein.

The long-chain aliphatic alcohol sulfates useful in the instant invention include the natural or synthetic alcohol sulfates having from 14 to 22 carbon atoms, and preferably 16 to 20 carbon atoms. Examples of useful alcohol sulfates include straight and branched chain alcohol sulfates, such as lauryl alcohol sulfate, myristyl alcohol sulfate, hexadecanol sulfate, cetyl alcohol sulfate, heptadecanol sulfate, octadecanol sulfate, stearyl alcohol sulfate, nondecanol sulfate, eicosanol sulfate, tallow alcohol sulfate, etc. and mixtures thereof. A typical commercially available natural alcohol sulfate contains a mixture of alcohols containing 3% $C_{14}$, 52% $C_{16}$, 32% $C_{18}$, 12% $C_{20}$, and 1% $C_{22}$. Ethoxylated alcohol sulfates may also be utilized to enhance the softness and whitening properties of the cationic quaternary softeners. The water-soluble salts of the alcohol sulfates, including the alkali metal, ammonium, lower amine, and alkanolamine salts, is also contemplated herein.

Although the incompatibility of even traces of anionics, such as higher aliphatic alcohol sulfates, with cationic quaternary ammonium softeners is well known in the prior art; it has nevertheless been found that minor amounts of aforesaid alcohol sulfates mixed with aforesaid quaternary ammonium softeners unexpectedly enhances the softening and whitening properties thereof. Weight ratios of 10:1 to 2:1 of cationic:alcohol sulfate appear to be most effective, although ratios of 8:1 to 4:1 give the best results, as shown by the following examples utilizing a one Towel Test.

One terry cloth hand towel is rinsed in 17 gallons of tap water at about 70° F. After air drying, the towel is rated for softness on a scale of 1, which represents no softness, to 10, which signifies excellent softness. Ratings of $10^{+}$ to $10^{+++}$ are assigned when the towel is particularly soft, more so than obtainable under practical laundry conditions. Whitening properties are shown on the *b* scale, wherein higher numerical values of +*b* means greater yellowing, and higher numerical values of −*b* signifies greater whitening.

EXAMPLE 1

30 g of a liquid softener containing 7.1% 2-heptadecyl-1-methyl-1-[2-stearoylamido)ethyl]imidazolinium methyl sulfate, 0.28%. *Calcofluor CSL brightener and 1.5% of a 1% solution of Acid Blue No. 80 and 87.8% water, was added to the rinse water and a towel was treated as described above. The towel received a softness rating of 10+ and a *b* value of +0.3.

*-4,4'bis{4-anilino-6-[N-(2-hydroxyethyl)-N-(2-carbamoyl ethyl) amino]-s-triazin-2-ylamino}-2,2' stilbene disulfonic acid.

EXAMPLE 2

0.25 grams of a commercially available mixture of higher aliphatic alcohol sulfates containing 14 to 22 carbon atoms as aforedefined was dispersed in 100 mol. hot water. 30 g of the liquid softener of Example 1 was added thereto, yielding a homogeneous liquid. This mixture was added to the rinse water and a towel was treated therewith as in Example 1. This towel was rated $10^{++}$ for softness and received a *b* value of −0.7.

This example represents an 8:1 weight ratio of cationic to alcohol sulfate and exhibited a significant improvement in both whiteness and softness over the towel treated with the cationic alone.

EXAMPLE 3

The alcohol sulfate content of Example 2 was increased to 0.5 g. The mixture of cationic and alcohol sulfate gave a homogeneous liquid. A towel treated with this mixture, which represents a 4:1 weight ratio of cationic:alcohol sulfate, yielded maximum softness of $10^{+++}$ and enhanced whiteness, a *b* value of −1.4.

EXAMPLE 4

The alcohol sulfate content of Example 3 is increased to 1.0 g and mixed with the cationic agent, yielding a homogeneous liquid. A towel treated herewith, as above described, was given a softness rating of 10 and a *b* value of −2.3. This represents a 2:1 weight ratio of cationic:alcohol sulfate.

EXAMPLE 5

The alcohol sulfate content of Example 3 is increased to 2.0 g and mixed as in Example 3 to give a homogeneous liquid. A towel treated with this composition gave a softness value of 8 and a *b* value of −4.5. Although this composition gave a whiter towel, the softness diminished significantly. The weight ratio of cationic:alcohol sulfate herein is 1:1. Thus, it is apparent that the weight ratio must be within certain limits in order to obtain both maximum softness and improved whiteness.

EXAMPLE 6

The alcohol sulfate content was increased to 4.0 g, which represents a weight ratio of 1:2 of cationic:alcohol sulfate. A towel treated herewith in accordance with the procedure of Example 1 gave a softness rating of 6 and a *b* value of −4.8. Although whiteness improved, softness decreased significantly.

The criticability of certain weight ratios of cationic to alcohol sulfate is clearly illustrated by the above examples. However, as shown above, ratios and concentrations may be varied within the range of 10:1 to 2:1, and preferably 8:1 to 4:1, of cationic:alcohol sulfate to effect the desired softening and whitening performance.

The softening composition of instant invention may also include minor amounts of brighteners, bluing, germicides, perfumes, or other additives which do not interfere with the softening and whitening properties of said composition.

This product may be prepared and used in liquid or solid form, adsorbed onto a carrier. The amount of quaternary softener present in the liquid composition may be within the range of 2–20%, and preferably about 4–15% by weight. The liquid composition may be sprayed on, or otherwise agglomerated with particles of borax, sodium carbonate, sodium bicarbonate, sodium sesquicarbonate, sodium sulfate, sodium chloride, phosphate salts, or other carrier materials, to form granular or powdered compositions. This solid product may also be formed into a pellet or other suitable shape. The amount of quaternary softener present in the powdered form may be 2–30%, and preferably 4–20% by weight.

EXAMPLE 7

50 g of a powdered softening composition comprising 5 g of 2-heptadecyl-1-methyl-1-[2-stearoylamido)ethyl] imidazolinium methyl sulfate, 1.25 g of a mixture of higher aliphatic alcohol sulfates containing 14 to 22 carbon atoms and 43.75 g sodium sulfate was added to the last rinse cycle during the laundering of fabrics. The same superior results were attained herewith, as in Example 3.

The recommended amount of softening composition useful in the final rinse of wash cycle is 30 to 60 g (1 to 2 capfuls), although more or lesser amounts can be utilized depending on the conditions of laundering, such as water temperature, degree of hardness of the water, the amount of the wash load, degree of soil in the wash load, capacity of washing machine, etc.

EXAMPLE 8

Tallow alcohol sulfate, which is a mixture of 60% alcohol sulfate containing 18 carbon atoms and 30% alcohol sulfate containing 16 carbon atoms may be substituted for the alcohol sulfate in Example 7. The same superior softness and whiteness is obtained.

The invention has found its greatest utility thus far in the softening of cotton fabrics, fabrics made of other cellulosic fibers, e.g., rayon or other textile fibers, e.g., nylon, silk, wool, polyethylene terephthalate, cellulose acetate, acrylonitrile polymers or copolymers, or blends of any two or more of these fibers (e.g., cotton-polyester blends). This softening composition may be applied to the fabric in an aqueous bath, either as a final rinse during laundering, or as a separate and distinct softening operation. In use, 30 to 60 g of the softening composition is added to an automatic washing machine or similar treating bath containing 17 gallons (35 liters) of water, and an average load of fabrics (about 6 to 8 pounds). However, lesser or greater amounts may be utilized to obtain the desired degree of softness and whiteness, depending on the water temperature, the amount of water and clothes, etc.

The presence of traces of anionics from the wash cycle does not adversely affect the superior properties of instant rinse product. Likewise, the presence of higher aliphatic alcohol sulfates as one of the anionic ingredients in the wash detergent formulation has substantially no effect, either good or bad, on the softening and whitening properties of instant softening product when utilized in the rinse cycle of a laundering operation. The following tests prove that instant softening composition functions equally well after a wash cycle in the presence of traces of anionics due to carryover, or in a separate softening operation wherein no traces of anionics are present in the rinsing bath.

A cupful (80 g) of commercial detergents was used in the wash cycle and subsequently rinsed with a softening composition. Towels treated herewith were rated for softness:

| | Wash Cycle Detergent | Final Rinse Softening Agent | Softness Rating |
|---|---|---|---|
| 1. | Anionic detergent containing higher aliphatic alcohol sulfate. | — | 1 |
| 2. | Same. | Quaternary softener: 2-heptadecyl-1-methyl-1-[(2-stearoylamido)ethyl] imidazolinium chloride. | $10^{++}$ |
| 3. | Same. | 4:1 quaternary softener: alcohol sulfate (of Example 2). | $10^{++++}$ |
| 4. | Anionic detergent. | — | 1 |
| 5. | Same. | Quaternary softener. | $10^{++}$ |
| 6. | Same. | 4:1 quaternary:alcohol sulfate. | $10^{+++++}$ |
| 7. | Low foaming detergent. | — | 1 |
| 8. | Same. | Quaternary softener. | 9 |
| 9. | Same. | 4:1 quaternary:alcohol sulfate. | $10^{+++}$ |
| 10. | — | Quaternary softener. | $10^{+}$ |
| 11. | — | 4:1 quaternary:alcohol sulfate. | $10^{++++}$ |

There was no noticeable difference in the degree of whiteness of the towels, all the towels being substantially equally white.

These results clearly show the unexpectedly superior results obtainable with instant softening formulation, which comprises a cationic quaternary softener and a minor amount of a higher aliphatic alcohol sulfate.

While various preferred embodiments of the present invention have been illustrated by means of specific examples, it is to be understood that the present invention is in no way to be deemed as limited thereto, but should be construed as broadly as all or any equivalents thereof.

What is claimed is:

1. A fabric-softening composition having improved softening and whitening properties consisting essentially of a cationic quaternary ammonium softener and a higher aliphatic alcohol sulfate, having from about 14 to about 22 carbon atoms, in the weight ratio of 10:1 to 2:1 of cationic:alcohol sulfate.

2. A fabric-softening composition of claim 1, wherein the cationic quaternary ammonium softener is an imidazolinium compound.

3. A fabric-softening composition of claim 2, wherein the cationic quaternary softener is 2-heptadecyl-1-methyl-1-[2-stearoylamido)ethyl]imidazolinium methyl sulfate.

4. A fabric softening composition of claim 1, wherein the alcohol sulfate contains 16 to 20 carbon atoms.

* * * * *